US005142253A

United States Patent [19]

Mallavarpu et al.

[11] Patent Number: 5,142,253

[45] Date of Patent: Aug. 25, 1992

[54] SPATIAL FIELD POWER COMBINER HAVING OFFSET COAXIAL TO PLANAR TRANSMISSION LINE TRANSITIONS

[75] Inventors: Raghuveer Mallavarpu, Acton; George H. MacMaster, Lexington; M. Paul Puri, Acton, all of Mass.

[73] Assignee: Raytheon Company, Arlington, Mass.

[21] Appl. No.: 517,873

[22] Filed: May 2, 1990

[51] Int. Cl.[5] ..... H01P 5/12

[52] U.S. Cl. ..... 333/127; 333/136; 333/26; 333/33

[58] Field of Search ..... 333/125, 127, 136, 26, 333/33; 330/286, 295

[56] References Cited

U.S. PATENT DOCUMENTS

| | | | |
|---|---|---|---|
| 2,963,664 | 12/1960 | Yeagley | 333/127 |
| 3,761,834 | 9/1973 | Dudley et al. | 330/61 |
| 4,035,746 | 7/1977 | Covington, Jr. | 333/127 |
| 4,163,955 | 8/1979 | Iden et al. | 333/127 |
| 4,283,685 | 8/1981 | MacMaster et al. | 333/125 X |
| 4,346,355 | 8/1982 | Tsukii | 333/33 |
| 4,424,496 | 1/1984 | Nichols et al. | 330/286 |
| 4,641,107 | 2/1987 | Kalokitis | 333/136 |
| 4,812,782 | 3/1989 | Ajioka | 333/125 X |
| 4,855,697 | 8/1989 | Jones et al. | 333/33 |
| 4,933,651 | 6/1990 | Benahim et al. | 333/125 |

FOREIGN PATENT DOCUMENTS

| | | | |
|---|---|---|---|
| 37703 | 3/1984 | Japan | 333/125 |

*Primary Examiner*—Eugene R. Laroche
*Assistant Examiner*—Benny Lee
*Attorney, Agent, or Firm*—Denis G. Maloney; Richard M. Sharkansky

[57] ABSTRACT

A cylindrical multi-port combiner having a graceful degradation characteristic with a high degree of isolation (25 db) between ports and a high combining efficiency (>90°) is disclosed. A radially-spaced inner and outer conductor forms a transmission line operating in a balanced mode. Circumferentially spaced plurality of like transmission lines have inner and outer RF absorbers at the outermost regions of the spaced adjacent inner and outer conductors, respectively. A corresponding end of each transmission line in adapted to be connected to one of a corresponding number of phase-matched RF sources. The other end of each transmission line has its inner and outer conductors connected in parallel, respectively, through stepped impedance-transforming transmission lines to form one connector for connection to an output RF load. The RF field of the desired balanced mode does not extend beyond adjacent inner and outer conductors to the absorbers; whereas when a failure of a source occurs, the resulting unbalanced mode will have its field extend to the absorbers to be damped without significantly affecting the output from the remaining operative sources.

18 Claims, 8 Drawing Sheets

SPATIAL FIELD POWER COMBINER HAVING OFFSET COAXIAL TO PLANAR TRANSMISSION LINE TRANSITIONS

BACKGROUND OF THE INVENTION

This invention relates to power combiners, and more particularly to a power combiner for microwave amplifiers, either tube or solid state types, each of whose output is applied as an input to one of a plurality of inputs of the combiner. In particular, the combiner may be advantageously used to combine the power of low-power, broadband travelling wavetubes (TWTs). The combiner provides a single output power substantially equal to the sum of powers provided by the input amplifiers.

There presently exists a need to provide a source of RF energy over a wide frequency band, e.g., 2.0–20 GHz, at power levels substantially an order of magnitude greater (hundreds of watts continuous) than is capable of being provided by currently available sources. There is also a need to have a source of RF power over this frequency range which does not suffer total loss of power output in the event that the tube providing the power fails. Thus, even if a tube capable of providing the desired power level over the frequency band were available, a source of power such as provided by this invention which results in only a reduction in power in the event of a tube failure is preferrable to total loss of RF power.

A divider/combiner amplifier circuit having internally mounted semiconductor amplifiers is disclosed in U.S. Pat. No. 4,424,496. In this patent, the input signal is divided and applied to each of a plurality of solid state amplifying elements mounted in a plurality of isolated channels which are combined to provide a single output. Failure of one or more of the amplifying elements produces a gradual dimunition of output power. The internally mounted amplifiers of the amplifier circuit of the referenced patent limits the total power output and frequency band of the combiner to a multiple of the power capability of each of the semiconductor amplifiers contained within the divider/combiner. Since these amplifiers are generally of low power output, the total power from the divider/combiner is more limited than is desired in many applications. There may also be a limitation with respect to the available bandwidth obtainable from each of the semiconductor amplifiers. A further possible limitation of the divider/combiner amplifier circuit of the referenced patent is that the divider portion of the amplifier circuit reduces the input power from a single source to each of the semiconductor amplifiers. There is no provision in the amplifier of the referenced patent for providing input power to a passive combiner circuit from a plurality of external amplifiers.

High CW powers (500 W to 1 kW) over multi-octave frequency bands up to 20 GHz are desired in several microwave applications. Normally a high-power TWT is used, but only partially satisfies the power-bandwidth requirements. Also a single tube high-power TWT has limitations in terms of the life, reliability, efficiency, etc. An alternate approach, as provided by this invention, is to power combine mini-TWTs. Since these tubes are highly reliable, efficient, and perform well over multi-octave bands, the problem is transferred to the power combiner which should have bandwidth and high-average power handling capabilities among other features.

The technique of power combining several devices to yield higher power is commonly used with solid state devices, such as GaAs FETs, GaAs Impatts, and bipolar transistors. For instance, GaAs Impatts have been combined in a $TM_{020}$ cavity to provide peak powers up to 1 kW at X-Band with 1% bandwidth. GaAs FET amplifiers are frequently combined using different versions of the radial combiner. Wilkinson, modified Wilkinson, and travelling wave combiner are other types of combiners normally used depending upon power and bandwidth requirements.

For applications which require high CW power handling (hundreds of watts continuous) over a multi-octave bandwidth the foregoing power combiners are inadequate. Each of the TWTs desired to be combined have outputs in the range of 50–250W CW, and it is essential that a high degree of isolation be maintained between the combiner input ports not only in the desired balanced mode of operation, but also when some of the TWTs have failed.

SUMMARY OF THE INVENTION

It is therefore an object of this invention to provide a RF energy combiner which provides a high output power over a broad bandwidth from a plurality of amplifiers external to the combiner, each amplifier being of relatively low output power.

It is a further object of this invention to provide a combiner for combining the outputs of a plurality of amplifiers which will provide an output power which falls off gradually with the failure of one or more of the driving amplifiers so that a catastrophic failure does not occur.

Compared with an approach using a single high power TWT, the combiner circuit of this invention has several significant advantages. These are lower DC power requirement, lower operating voltages, elimination of a solenoid and power supply for the low power TWTs, graceful degradation, increased life, improved repairability and higher reliability.

As an example, for a 6-way combiner for the band 6–18 GHz and assuming 250W TWTs being combined, then the total DC power input of the TWTs applied to the combiner is less than 4.8 kilowatts, nearly 4 kilowatts less than required for an equivalent single high-power high-voltage TWT with solenoid focusing. This will result in reduced power supply size, weight and power dissipation. Additionally, electrical and thermal loads on the system will be reduced.

The operating beam voltage of 6.2 kV for low power TWTs as in the preceding example is significantly less than the typical 10 kV or higher required for a single high power TWT. This increases reliability of high voltage insulation under airborne environmental conditions. As a result of each low-power mini-TWT being focused with permanent magnets, the need for a focusing solenoid and power supply is eliminated. This results in reduced power consumption and weight.

Multiple low power TWTs in a combiner configuration provides the advantage of graceful degradation. A catastrophic failure in one or more TWTs will not result in a complete system failure and the transmitter will still provide power output. Cooling of the combiner allows it to dissipate unbalanced mode power of the level of several hundred watts which would occur upon the failure of one-half (which produces maximum dissipation in the combiner) the number of input sources.

Operating life of mini-TWTs exceeds 10,000 hours. This is a significant improvement over the life from a single high power TWT. This, in combination with the graceful degradation feature, will significantly increase system MTBF over the single TWT approach.

Repairability of the proposed device is a feature which can greatly reduce the system life cycle cost. This results from the number of major components which can be replaced without the need for vacuum envelope processing, namely the individual TWTs, and the combiner. An estimated cost of major repair (replacement of the TWT) for the proposed device is a factor of four less than for a single high power TWT. Reuseability of the passive components, the combiner and tube housing also reduced the average cost to repair.

Factors which provide higher reliability are lower operating voltage, reduced thermal dissipation, lower-power active devices (mini-TWTs) and graceful degradation.

The compact combiner of this invention has been developed to provide these recited features.

These and further objects and features are achieved by the cylindrical multi-port combiner of this invention which has a graceful degradation characteristic with a high degree of isolation (25 db) between ports and a high combining efficiency (>90%). The combiner in a preferred embodiment has circumferentially-separated inner and outer conductors which are radially-spaced forming a plurality of transmission lines, operating in a balanced mode. The radially-spaced inner and outer conductors of each transmission line extend longitudinally and have inner and outer RF absorbers at the outermost regions of each of the circumferentially-spaced adjacent inner and outer conductors, respectively. A corresponding end of each of the plurality of transmission lines is adapted to provide a matched impedance to connectors to which is connected one of a corresponding number of phased-matched RF sources. The other end of each transmission line has its inner and outer conductors connected in parallel, respectively, through stepped impedance transforming sections to form one output connector for connection to an RF load. The transmission lines and impedance transforming sections are sectored by longitudinal slots and support an RF field of the desired balanced mode which does not extend beyond facing surfaces of adjacent radially-spaced inner and outer conductors to the absorbers. When a failure of a source occurs, the resulting unbalanced mode will produce a field which extends into the absorbers which attenuate the field of the unbalanced mode and results in stability of the co-existing balanced mode.

The power output $P_o$ in the balanced mode follows the graceful degradation relation given below.

$$P_o=\eta\cdot((n-f)/n)^2\cdot P_T$$

n=number of input ports f=number of failed sources $P_T$=power sum of all sources originally providing power $\eta$=efficiency (typically 90–95%)

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENT

Figure 1:
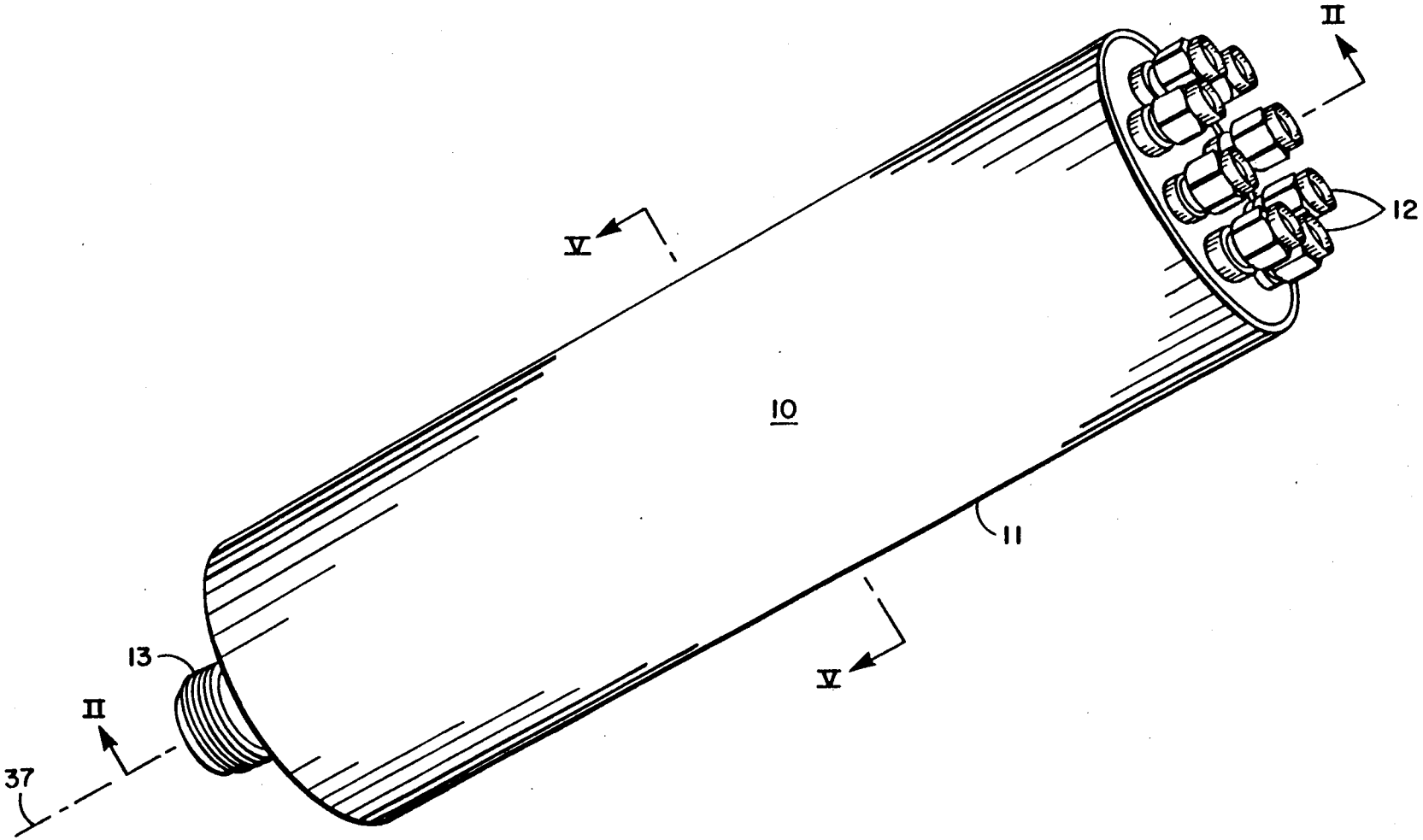
FIG. 1 is an isometric view of the combiner of this invention.

FIG. 1 shows an isometric view of the combiner 10 of this invention. Combiner 10 comprises an enclosure 11 containing microwave circuitry for impedance matching of the plurality of input terminals 12 to internal transmission lines which are impedance transformed by stepped transmission lines before being combined and impedance matched to the single output terminal 13.

Figure 2:
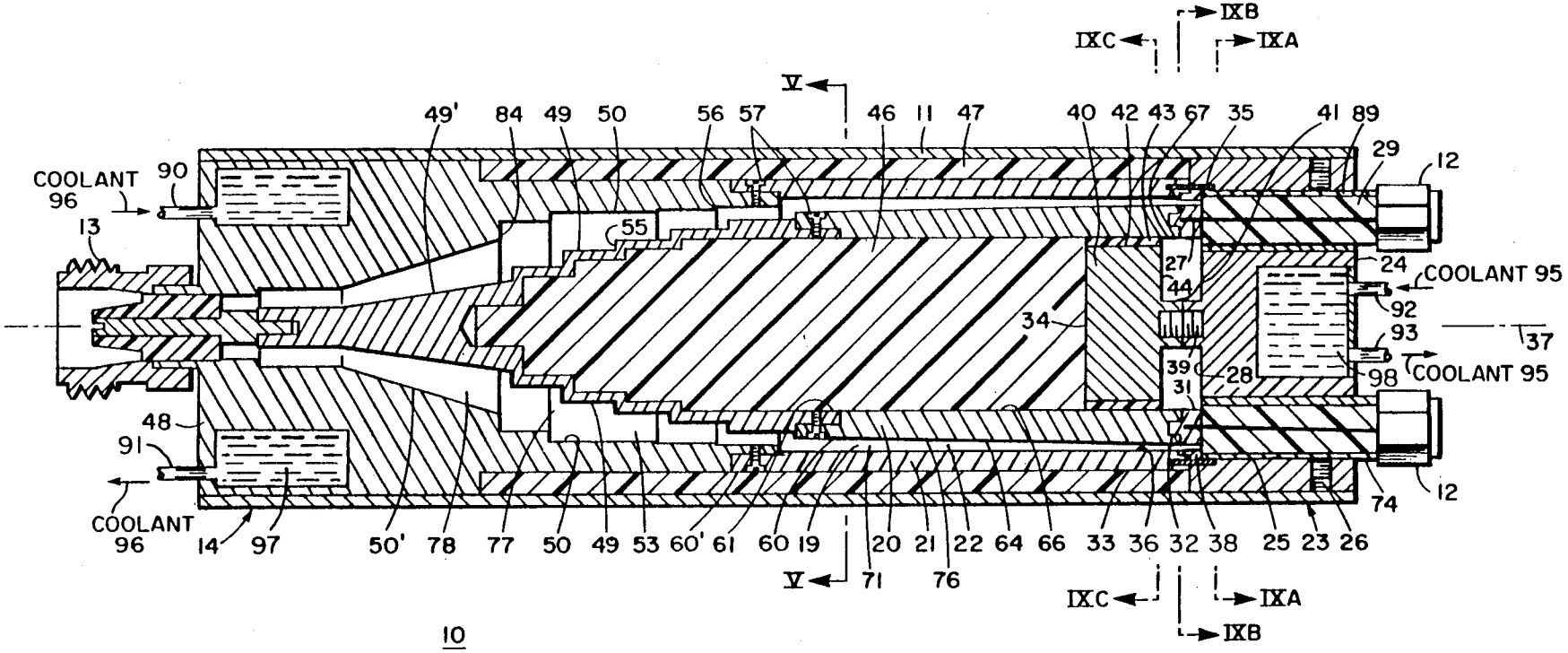
FIG. 2 is a longitudinal cross-sectional view taken along section lines II—II of FIG. 1.

Referring now to FIG. 2, the combiner 10 of FIG. 1 is shown in longitudinal cross section taken along section lines II—II of FIG. 1. The combiner 10 comprises a longitudinally slotted cylindrical inner conductor 20 and a longitudinally slotted outer cylindrical conductor 21. RF energy provided to input connectors 12 propagates in the space 22 of transmission lines 19 formed by each pair of opposite inner and outer conductors 20, 21, respectively, to the combined output at connector 13. The input portion 23 of combiner 10 comprises a connector end-support 24 which contains (for an 8-way combiner) eight equi-angle spaced holes 25 in which the coaxial conductor 74 attached to connectors 12 are secured by set screws 26. The center conductor 27 of coaxial conductor 74 extends beyond the inner wall 28 of end support 24 whereas the insulation 29 and outer conductor 89 terminate flush with the wall 28. A longitudinally extending cylindrical support 38 of end support 24 provides a stop for outer conductor 89 to control the extent to which center conductor 27 extends beyond the inner wall 28. A metallic sleeve 31 slips over the center conductor 27 to make electrical and mechanical contact therewith. The sleeve has a small diameter portion 32 which mates with hole 68 in end 67 (FIG. 4A–4C) of the inner conductor 20. The larger diameter portion of sleeve 31 extends to surface 64 (FIG. 4A) of conductor 20. Sleeve 31 thereby forms the center conductor of an offset coaxial line whose outer conductor is formed by the cylindrical axial projection support 38. The offset coaxial line has an impedance of fifty ohms to match the fifty ohm impedance of coaxial conductor 74 and the fifty ohm impedance of transmission line 19 to which it is connected.

The outer conductor 21 has an end 33 hole by which it is removably secured by pin 35 which is press fit into end support 24. The inner surface 36 of the end 33 of outer conductor 21 is recessed and rests on the axial cylinder support 38 projecting from wall 28 of end support 24 to provide a smooth surface 36 in the region of sleeve 31. The inner conductor 20 is uniformly sloped from the outer conductor 21 by an air gap 22.

Connected to end support 24 by a screw 39 is an electrically conducting cylinder 40 having a first diameter 41 and a second larger diameter 42. Diameter 42 is sufficiently smaller than the inner diameter of conductors 20 for insertion of a cylinder of microwave absorbing material 43 between cylinder 40 and inner conductor 20. Cylinder 40 has a wall 44 which is spaced from the wall 28 of end support 24 which together with the first diameter 41 of cylinder 40 forms a cavity 45. A short circuit input impedance as viewed from cavity 45 at a resonance frequency above the operating band is desired of the quarter-wavelength transmission line occupied by material 43. Cavity 45 acts to tune the spurious modes to a frequency above the operating band of the device. The axial length of cylinder 40 is established to provide the short circuit impedance. Material 43 may be omitted but its presence is preferred in order to absorb energy which may exist at its location from unbalanced mode energy from segmented conductors 20 as discussed later with reference to FIG. 7. Abutting the end 34 of cylinder 40 is an electrically nonconductive microwave absorbing material 46 in the form of a stepped cylinder which is preferrably in contact with surrounding segmented inner conductors 20, 49.

In contact with the outer conductors 21, 50 is a cylinder of electrically nonconductive microwave absorbing material 47 which is split longitudinally into two halves 47', 47" (FIG. 5) to facilitate placing the material 47 around the circumference of the outer conductor 21.

Referring now to the output end 14 of the combiner 10, an end support 48 supports the output connector 13 and the inner stepped conductor 49 and outer stepped conductor 50. The inner conductors 49 and the outer conductors 50 are longitudinally segmented by air gap slots 51, 52, respectively as shown in the isometric view of the combiner 10 in FIG. 3. Slots 51, 52 are a continuation of slots 72, 73 (FIG. 5) separating conductors 20, 21, respectively. The inner stepped conductors 49 have slots 52 in radial alignment with the slots 51 of the outer slotted conductors 50. The number of slots 51, 52 is determined by the number of input terminals 12. The slotted conductors 49, 50 are separated by the air gap 53 and form stepped transmission lines 77 of the parallel plane type. Lines 77 supports a TEM longitudinal propagation of the electromagnetic energy provided by microwave transmission lines 19 formed by the radially spaced slotted conductors 20, 21 connected to conductors 49, 50, respectively. The radius and width of the stepped slotted conductors 49, 50 decreases at their ends nearest the output connector 13. The slots 51, 52 terminate at the smallest diameter of the stepped slotted conductors 49, 50, where the conductors become solid conductors 49', 50', respectively. The ratio of the diameters of conductors 49, 50 increases at each step toward connector 13 to increase the impedance of stepped transmission line 77 at each step. The impedance of the tapered coaxial line 78 is Z (50 ohms in practice). The slotted transmission line 77 begins at region 84 where the impedance is nZ ohms. The stepped transmission line 77 transforms this impedance to Z ohms at the region when it is connected to transmission line 19. Region 84 is where slots 51, 52 terminate to form coaxial line 78. "n" is the number of inputs 12. For n equal to eight inputs and Z equal and Z equal to fifty ohms, $nZ=400$ ohms. The parallel impedance of the eight lines 77 at the region 84 is $Z=50$ ohms which matches the impedance of tapered coaxial line 78 and the connector 13, each of which has a 50 ohm impedance. As a consequence, the parallel connected stepped transmission lines 77 provide a match between the 50 ohm impedance of the tapered coaxial line 78 formed by conductors 49', 50' and the 50 ohm impedance of the parallel plane transmission line 19 formed by conductors 20, 21. The inner 49' and outer 50' conductors have diameters whose ratio is constant therefore providing a fifty ohm impedance over the length of coaxial line 78. The number of steps 55, 56, the height of the steps, the longitudinal extent of each of the steps, and the longitudinal displacement of the steps of conductor 49, 50 are designed to provide a Tchebyscheff or binomial maximally flat impedance match over the frequency bandwidth at which the combiner 10 is to be used. In the design of the preferred embodiment, 6 steps should result in an insertion loss of less than 0.5 db over the frequency band of 2.5–10 GHz.

The stepped conductors 49, 50 are connected by screws 57 to ends 60, 60' of the conductors 20, 21, respectively. The other end of conductor 20 is attached by sleeve 31 to the center conductor 27 of coaxial line 74. The length and diameter of the sleeve 31 between the end of conductor 20 and the insulation 29 of line 74 is selected to provide an impedance match between the impedance of the coaxial line 74 and the impedance of the transmission line 19 formed by conductors 20, 21. The other end of outer conductor 21 is connected by a pin 35 to the end 24 and rests on cylindrical support 38 of end 24. Conductor 21 has an inner surface 36 and an outer surface of different constant radii and is of uniform cross section throughout its length.

Figure 3:
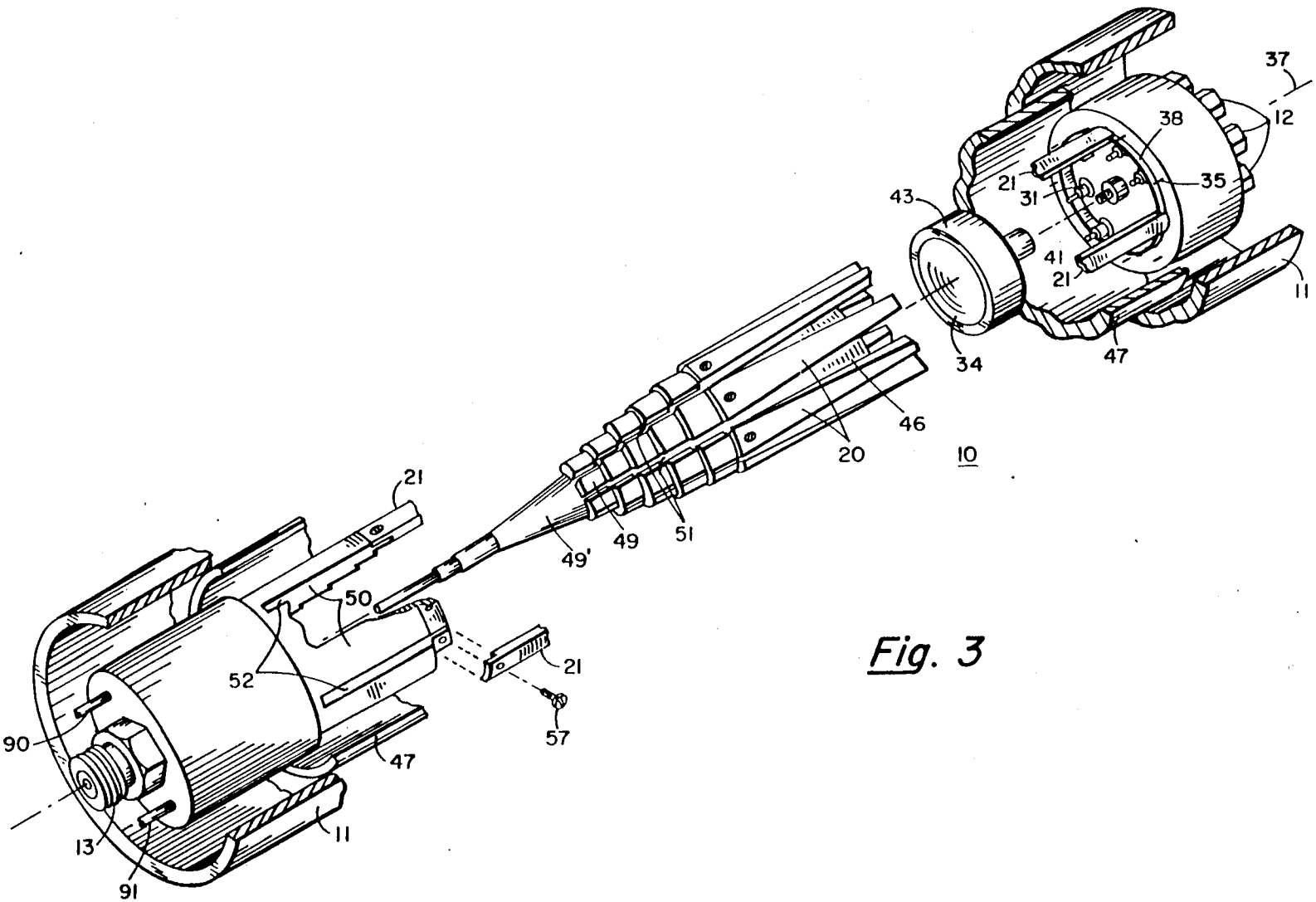
FIG. 3 is an exploded isometric view of the combiner 10.
Figure 4C:
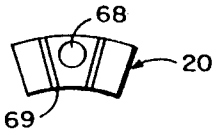
FIGS. 4(C) and 4(D) are right and left end views, respectively of the inner conductor 20 of FIG. 4(A).
Figure 4A:
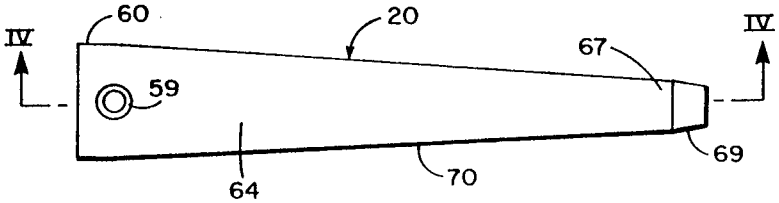
FIG. 4(A) is a plan view of the inner conductor 20 of FIGS. 2 and 3.
Figure 4B:
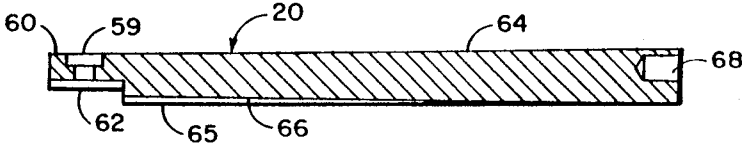
FIG. 4(B) is a cross-sectional view of FIG. 4(A) taken along section lines IV—IV.
Figure 4D:
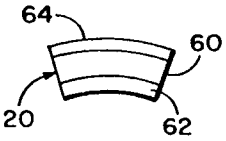

Inner conductor 20 is constructed in accordance with the views shown in FIGS. 4A–4D. The top view of conductor 20 is seen in FIG. 4A to taper in the longitudinal direction from a width which is the same as that of the inner stepped conductor 49 where they join each other by a screw 57 penetrating the aperture 59 of end 60 of conductor 20. End 60 has an recess 62 which overlaps a mating recess 61 (FIG. 2) at the end of inner stepped conductor 49. FIG. 4D is an end view of conductor 20 showing the recess 62 of end 60 and the sloping top surface 64 of conductor 20. A longitudinal sectional view of conductor 20 taken along section lines IV—IV of FIG. 4A is shown in FIG. 4B which shows the sloping top surface 64 of conductor 20. FIG. 4B also shows the inner surface 66 of conductor 20, which is at a constant radius from the axis 37 (FIGS. 1–3) of combiner 10 as are the inner and outer surfaces of conductor 21. Surface 66 and back edge 65 appear to diverge in FIG. 4B because the width of conductor 20 varies as shown in FIG. 4A.

The other end 67 of inner conductor 20 contains a longitudinally extending aperture 68 as shown in FIG. 4B and in FIG. 4C, which is an end 67 view of conductor 20. The aperture 68 is the same diameter as the smaller diameter of the sleeve 31 of FIG. 2. Sleeve 31, slipped over closely fitting center conductor 27, provides support for the conductor 20 at end 67. End 67 has tapers 69 (FIGS. 4A and 4C) in the transverse direction which are greater than the taper 70 (FIG. 4A) over the main portion of the conductor 20. Tapers 69 provide an impedance match at the offset transmission line formed by the larger diameter of sleeve 31 and the cylindrical support 38. Taper 70 produces an increase in width of conductor 20, and in conjunction with a corresponding increase in spacing 22 produced by sloping surface 64 of conductor 20, causes the impedance of transmission line 19 formed by conductors 20, 21 to be maintained constant (fifty ohms) along its length. The sloping top surface 64 is also illustrated in FIG. 2.

FIG. 3 is an exploded isometric view of the combiner 10 of FIGS. 1, 2 showing certain aspects of the preferred embodiment more clearly than in the cross-sectional view of FIG. 2. Corresponding elements of FIGS. 2, 3 are identified by the same indicia.

Figure 5:
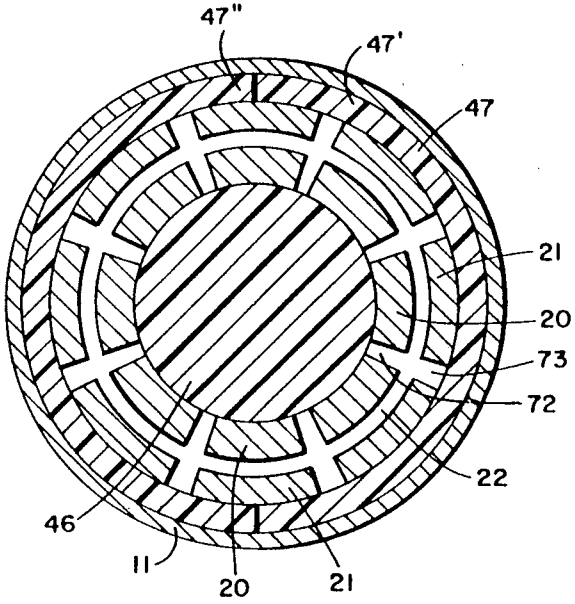
FIG. 5 is a cross-sectional view of the combiner of FIGs. 1 and 2 taken along section lines V—V.

FIG. 5 shows a cross-sectional view of the combiner 10 taken along section lines V—V of FIG. 2. FIG. 5 shows the inner and outer conductors 20, 21, respectively, which are separated by the air gap spacing 22 to form a transmission line 19 capable of supporting propagation of a TEM mode down the length of the conductors 20, 21. Each pair of conductors 20, 21 are separated from an adjacent pair of conductors 20, 21 by air gap slots 72, 73 respectively. Abutting the inner conductor 20 and the air gap 72 is the cylinder of absorbing material 46 which extends along the length of the conductors 20, 21 for at least that portion of the conductors separated by the slot 72. Surrounding the outer conductors 21 and the slot 73 is a tubular cylinder of microwave absorbing material 47, which also extends for at least the length of the slot 73. The outer metallic shell 11 serves as a containing and supporting member for holding together the abutting semi-cylindrical halves 47', 47" of the microwave absorbing material 47. Shell 11 is preferably attached to the end supports 24, 48 to provide a secured outer covering for the combiner 10.

Although the combiner 10 operates with a combining efficiency of 90-95%, the small loss in power can result in a substantial increase in operating temperature when it is combining the power from eight 100 watt sources. This is so because typically the combiner occupies a small volume (e.g. a cylinder 1½"-2" diameter with a length of 5"-6"). As shown in FIG. 2, in order to control the temperature rise, a coolant chamber 97, fabricated as part of combiner end 48, has a coolant 96 which enter and exits through pipes 90, 91, respectively. Similarly, a chamber 98 fabricated as part of combiner end 24 has a coolant 95 which enters and exits through pipes 92, 93, respectively. Ends 24, 48 are in mechanical contact with the absorber 47 and outer conductor 21 to carry away heat generated in the absorber 47 by RF losses. Similarly, the inner absorber 46 is in mechanical contact with stepped conductors 49, inner conductors 20, and the cylinder of metallic material 40 to carry away heat generated in absorber 46 by RF energy. Cylinder 40 transfers heat to end 24 through RF absorber 43 and screw 39 connecting abutting threaded portions.

Cylinder 40 is separated from the inner conductors 20 by a hollow cylindrical absorber 43 which is typically the same material as absorber 46 and acts to absorb unbalanced modes in the same manner. Absorbers 43, 46, 47 are typically made of silicon carbide which is suitable because of its lossy RF characteristic, non-electrical conductivity, and its good thermal conductivity. The axial length of the metallically conductive cylinder 40 is established to present a short circuit impedance as viewed from the cavity region 45 of the cavity formed of the absorber 43, inner conductor 20, and metallic cylinder 40.

An alternate embodiment of the invention replaces the cylinder of absorbing material 43 by a corresponding air gap having the axial length of the metallic cylinder 40, modified to take into account the dielectric constant of air from that of the absorber material 43 in order to maintain the short circuit impedance. The short circuit impedance occurs at a frequency higher than that of the operating band. The cavity 45 serves to tune the spurious modes to a higher frequency outside the operating band.

Figure 6:
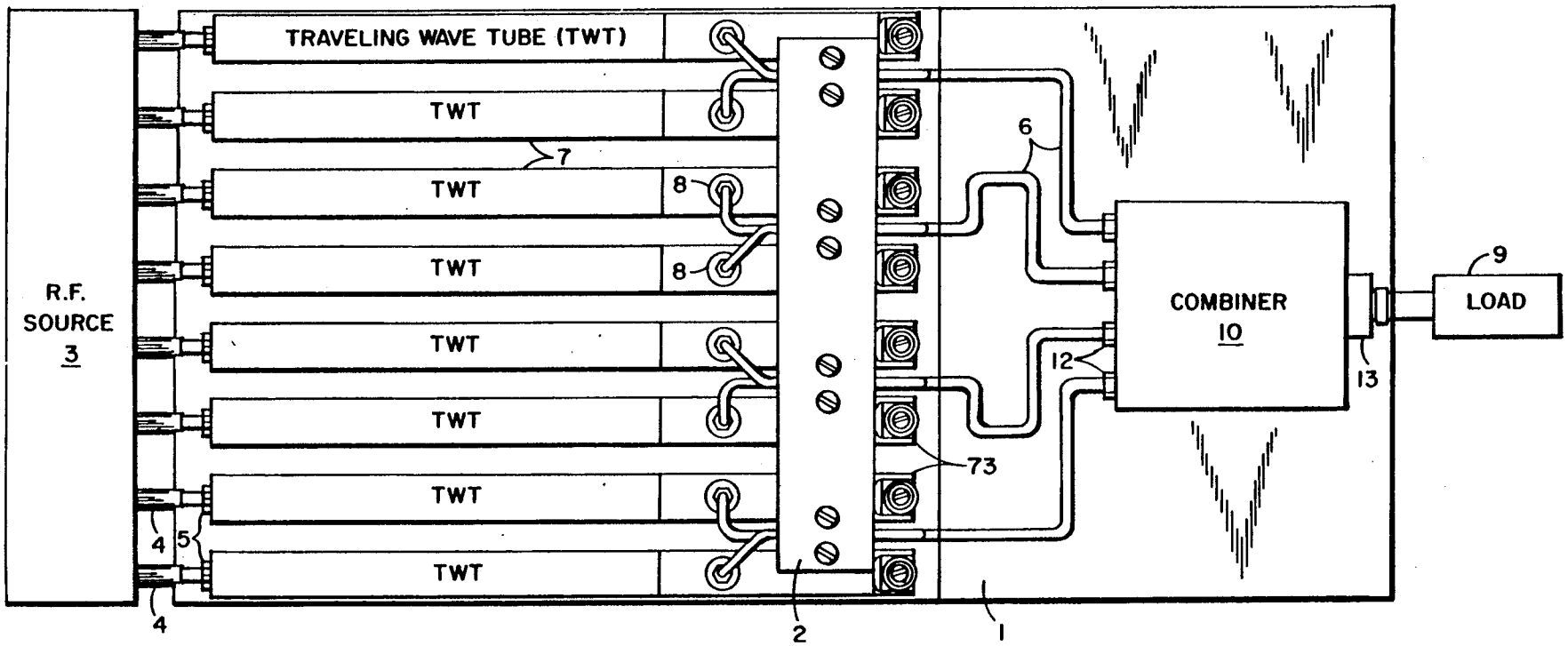
FIG. 6 is a pictorial view showing the connection of the combiner 10 to multiple RF sources and a single load.

FIG. 6 is a pictorial view showing the combiner 10 connected by its output connector 13 to a load 9. The input connectors 12 of the combiner 10 are shown connected to the output connectors 8 of low-power TWTs 7 by semi-rigid coaxial lines 6. The input connectors 5 of the TWTs 7 are connected to the multiple output lines 4 of an RF source 3. Because of the symmetry of the combiner 10, the phase shift in each channel of the combiner is substantially identical and therefore any phase shift differences at its output are produced by the TWTs 7. A support structure 2 is provided for the TWTs 7 and the coaxial output lines 6. Heat sinks 73 forming a part of the TWTs 7 are in good thermal contact with base plate 1 and provide cooling for the TWTs.

In operation, the RF source 3 provides in-phase substantially equal amplitude RF energy to the input terminals 5 of the TWTs 7. The frequency provided by the RF source may be any frequency within a band of frequencies, such as from 2.5-10 GHz. The TWTs 7 are selected to have substantially matched phases over the frequency band. The phase matching need not be perfect but any deviation will result in a slight loss of power provided by the combiner 10 to the load 9. The insertion loss of the combiner operated with 8 TWTs should be less than one-half decibel (a combining efficiency greater than 90%) over the desired band of operation. Each of the transmission lines 6 have a 50 ohm characteristic impedance. The combiner 10 is designed for impedance matched operation and thus has 50 ohm input impedance as viewed from its input terminals 12.

Referring to FIG. 2 the coaxial line 74 connected to each input terminal 12 is a 50 ohm transmission line whose center conductor 27 passes through a sleeve 31 whose diameter in the region between the insulation 29 of the coaxial line 74 and the end of inner conductor 20 is established at a diameter to provide substantially 50 ohm impedance in cavity region 45. The width of inner conductor 20 and its spacing from the outer conductor 21 is also established to provide a 50 ohm impedance at the sleeve 31. The width and thickness of the conductor 21 are maintained constant over its length. However, the spacing 22 between conductors 20 and 21 is linearly increased to end 60 of conductor 20 along with a linear increase in the width of conductor 20 as extends toward the end 60 to maintain a 50 ohm impedance in transmission line 19 formed of conductors 20, 21. In order to increase the spacing 71 between the conductors 20, 21, the outer surface 76 of conductor 20 is sloped down toward the longitudinal axis 37. The inside surface 66 of conductor 20 is maintained at a constant radius from the longitudinal axis 37. The combination of linearly increasing the spacing between the conductors 20, 21 while simultaneously linearly increasing the width of conductor 20 to the width of conductors 21 at ends 60, 60' causes the impedance of the transmission line 19 formed by the conductors 20, 21 to be maintained at substantially 50 ohms.

Since the impedance of the connector 13 is also 50 ohms, provision must be made for transforming the impedance of each of the eight fifty-ohm transmission lines 19 to transmissions lines 77, each having an impedance of 400 ohms so that their parallel combination at region 84 forms a single fifty-ohm coaxial line 78. In order to provide 400 ohm lines 77 at the region 84 at the ends of segmented conductors 49, 50 there exists an impedance transforming steps 55, 56 whose define the length and spacing of conductors 49, 50 to provide impedance changes which results in a 400 ohm impedance of lines 77 at ends 84 over the bandwidth of operation, 2.5–10 GHz in the example of this preferred embodiment. Multiple steps 55, 56 in the TEM mode transmission line 77 are necessary to provide the desired bandwidth.

Spurious undesired modes may be established by the termination of the circumferentially-sectored transmission lines 19 formed by conductors 20, 21 in the cavity 45 where they are terminated by the sleeve 31 and the coaxial lines 74. The mode tuning cylinder 40 is made of an electrically conductive material which is in thermal conduct with the electrically non-conductive microwave absorber 46 thereby providing a heat dissipating path for the energy absorber 46 through end-support 24 to the external environment. Cylinder 40 is attached to end-support 24 by screw 39. The diameter of portion 41 of the cylinder 40 is the same as the diameter of the mating portion of end-support 24 and is substantially smaller than the diameter of the main body 42 of cylinder 40. Absorber 43 extends to the end of slotted lines 20, 21 and forms a hollow cylinder 43 occupying the space around cylinder 40. Absorber 43 absorbs microwave power which is undesirably transmitted through slots 72 in the unbalanced mode in the case of failure of a TWT source 7. The cavity 45 formed by cylinder 40 and the inner wall 28 of the end-support 24 provides an undesired-mode tuner which prevents the undesired mode from being present in the operating band.

Figure 9C:
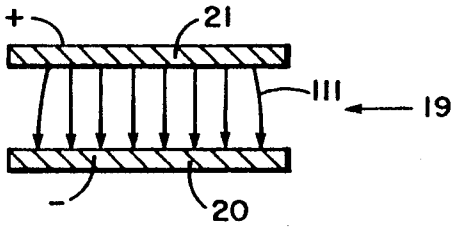
FIGS. 9A–9C show electric field patterns of coaxial conductor 74, the assembly of sleeves 31 in cavity 45, and the parallel-plane transmission line 19, taken along section lines IXA—IXA; IXB—IXB; and IXC—IXC of FIG. 2, respectively.
Figure 9B:
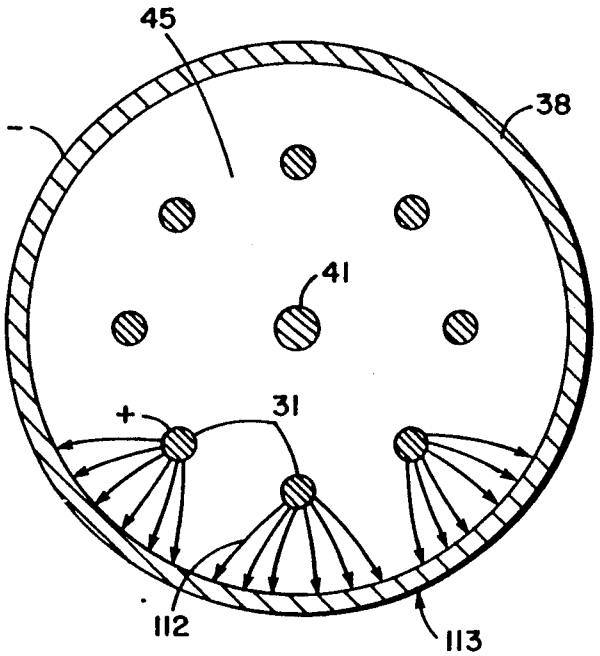
Figure 9A:
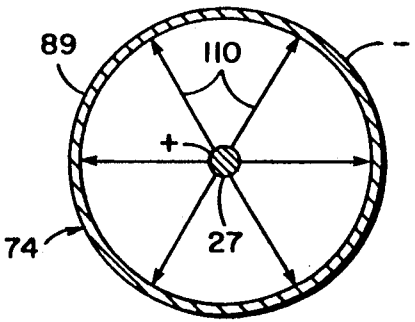

The transition in the cavity 45 region from the coaxial line 74 to the parallel plane transmission line 19 in order to provide matched impedance TEM mode propagation produces spurious resonance modes in cavity 45 whose frequency may fall in the operating band and cause a serious loss in output energy at that frequency. As shown in the electric field end views of FIGS. 9A–9C, the objective of the transition region is to transform the circularly symmetric E-field 110 of coaxial line 74 shown in FIG. 9A into the substantially parallel field lines 111 of the parallel plane transmission line 19 formed by conductors 20, 21 shown in FIG. 9C. This transition is achieved by having an intermediate offset coaxial line 113 of FIG. 9B (for each input coaxial line 74) whose offset "center" conductor is provided by a corresponding one of the sleeves 31 and whose outer conductor comprises the inner surface of cylindrical support 38. The offset coaxial line concentrates the E-field 110 provided by coaxial line 74 into the E-field 112 of FIG. 9B. The field is strongest where the electrically conductive sleeve 31 and support 38 are closest. When, as in this invention, a plurality of offset coaxial lines 113 are formed by the plurality of sleeves 31 symmetrically disposed within support 38, the resultant cavity 45 has dimensions which can support spurious resonances falling within the operating band of frequencies.

The generation of modes in the transition from the coaxial line 74 to the parallel plane line 19 for TEM mode propagation was recognized when as in the initial design the absorber 46 was extended to the end 67 of the tapered parallel plane line 19 and adjacent to wall 28 of end 24, a spurious dip in output energy from the combiner 10 occurred in the middle of the operating band. Increasing the axial length of cavity 45 by shortening absorber 46 had the effect of upwardly shifting the resonance frequency but the frequency remained within the operating band. The solution for moving the resonance frequency out of the band was to introduce a cylinder 40 of metallic electrically-conductive material (a mode tuner) which resulted in the cavity 45 defined by its surface 44, end 24 surface 28, and the inner surface of cylindrical support 38. The cylinder 40 is a quarter-wavelength long in the axial 37 direction to create a short-circuit impedance looking into the gap containing absorber 43 between inner conductor 20 and the circumference of cylinder 40 as viewed from cavity 45. The resulting reduced dimensions of cavity 45 shifted its energy-absorbing resonance frequency above the band of operation to thereby result in low-loss transmission across the entire operating band of the combiner.

Each of the transmission lines 19, 77 formed by the sectored conductors 20, 21 and their associated sectored, impedance matching stepped conductors 55, 56, respectively, are operated in a balanced TEM mode. In-phase RF voltages are provided to the inputs of the transmission lines 19 and the resulting electric magnetic fields are confined to the space 22 between the conductors 20, 21 with little if any fringing field impinging upon an adjacent transmission line 19. A transition region 84 provides a mode transformation from the transmission line 77 TEM mode to the TEM mode of the coaxial transmission line 78.

With eight signals balanced in phase and amplitude fed into the coaxial input ports 12, the combiner operates with a combining efficiency which varies over the band of operation but is typically 90–95% efficient (averaging about ½ db of insertion loss) and a TEM mode propagates in each of the transmission pairs of the combiner.

Should any of the amplifiers 7 connected to the combiner fail, then in addition unbalanced modes are generated. The field pattern of the unbalanced mode is also TEM but is orthogonal to the balanced mode between conductors 20 and 21. More specifically, the TEM unbalanced mode exists between adjacent inner conductors 20 and between adjacent outer conductors 21, whose fringing fields will extend to the microwave absorbers 46, 47, where they are effectively filtered by absorption. The balanced mode of the unfailed amplifiers continue to provide a balanced mode on the transmission lines 19 formed by conductors 20, 21. The combiner output from connector 13 follows the theoretical graceful degradation of output power with the number of failed sources.

Figure 7C:
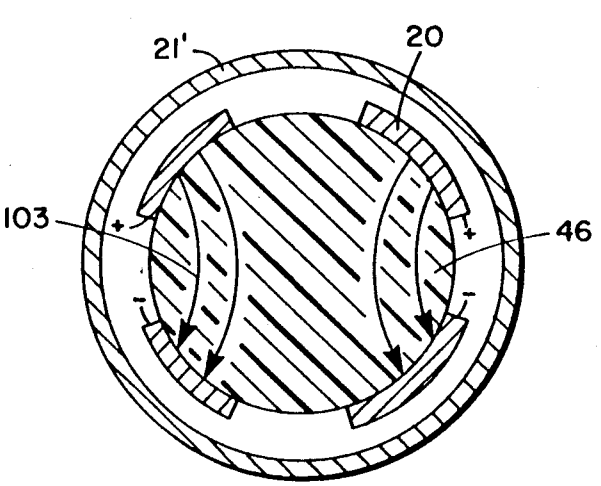
FIGS. 7A–7C show electrical field lines for a four-way combiner when operated in a desired balanced mode and for a pair of unbalanced modes, respectively.
Figure 7B:
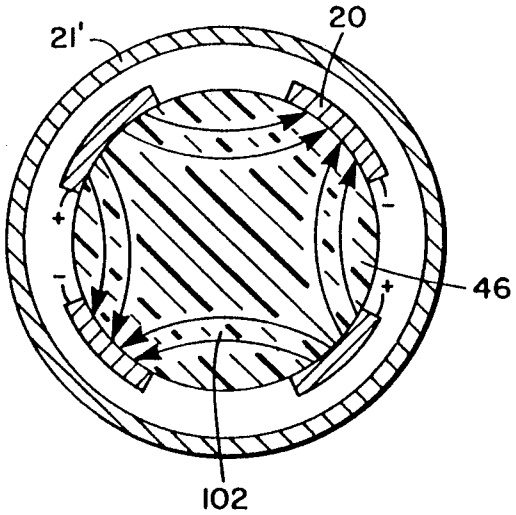
Figure 7A:
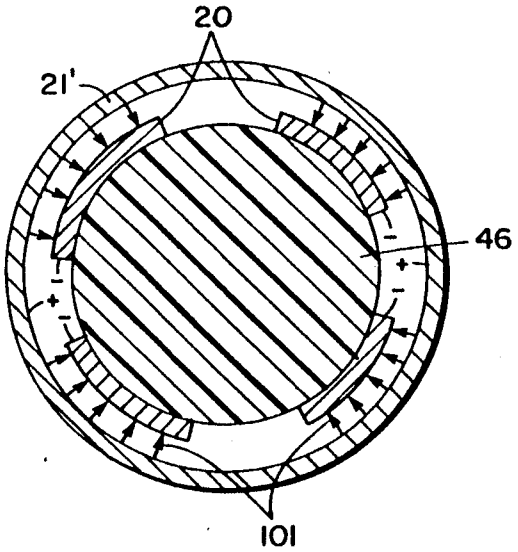

FIGS. 7A–7C show a cross-sectional view of an embodiment for a 4-way power combiner corresponding to the cross-sectional view of FIG. 5. Corresponding elements are assigned the same indicia as were used in FIG. 5. FIG. 7(A)-7(C) differs from FIG. 5 in that the outer conductor 21' is not segmented but is a cylinder of electrically conductive material without longitudinal slots. Segmented inner conductors 20 surround the microwave absorbing material 46. Since outer conductor 21' is a continuous hollow cylinder, the microwave absorber 47 of FIG. 5 is not required since the fields of FIG. 7A-7C between the outer conductor 21' and the inner conductors 20 cannot extend out beyond conductor 21'. Outer conductors 50 in this alternate embodiment would be stepped as in the combiner of FIG. 2, however the slots 51 would be absent.

FIG. 7(A) shows the field 101 in the desired balanced mode as being confined between conductors 20, 21'. Thus, the field does not impinge upon the load 46 and hence the insertion loss in the desired mode of operation is low with resultant high efficiency of transmission. It should be noted that the outer conductor 21' functions as a ground plane whereas the inner conductor 20 has an instantaneous relative polarity which is either positive (+) or negative (−) depending upon the portion of the RF cycle. FIG. 7(A) shows a situation where the inner conductor 20 is at a negative potential with respect to the outer conductor 21'.

FIG. 7(B) shows an unbalanced mode field pattern 102 where the adjacent inner conductors 20 are of opposite instantaneous polarity. The field lines 102 are seen to extend between adjacent conductors 20 following a path through the microwave absorbing material 46 which attenuates the field 102. Adjacent conductors 20 have alternately positive and negative potentials relative to the ground plane provided by conductor 21'. FIG. 7(C) shows another unbalanced mode field 103 which exists when one pair of adjacent inner conductors 20 have the same instantaneous polarity relative to the remaining pair of conductors which are at the opposite instantaneous polarity. Again, it is seen that the field lines 103 will be absorbed by the microwave absorbing material 46. The actual field existing within the combiner will be a composite of the fields of FIGS. 7A-7C.

If the outer conductor 21 is longitudinally slotted, as in FIGS. 2, 3, and 5, each outer conductor 21 will be of opposite polarity from that of a corresponding inner conductor 20 and will provide balanced mode and unbalanced mode fields similar to those shown in FIGS. 7(A)-7(C). The balanced mode field will be coupled between conductors 20, 21 as shown in FIG. 7(A) and hence not be attenuated by the absorber material 46, 47 even though conductor 21 is slotted. However, for the unbalanced modes of FIGS. 7(B) and 7(C), field patterns similar to fields 102 and 103 of FIGS. 7(B) and 7(C) will exist between the outer slotted conductors 21 and will extend into the region occupied by the microwave absorbing material 47 where the unbalanced mode fields will be also attenuated.

Another important consideration in the combiner is the isolation between input ports 12. The filtering property of the combiner, whereby the unbalanced modes are damped out by the microwave absorbers 46, 47 leads to a high-degree of isolation between the input ports 12 of the combiner. Isolation as high as 25 db between ports is typical for the combiner of the preferred embodiment.

Noise measurements made on the combiner 10 show that the filtering action of the microwave absorbers 46, 47 within the combiner 10 cancels the broadband noise eminating from each of the eight TWTs used as sources and the noise performance of the output of the combiner is better or equivalent to that of an individual tube.

In summary, the combiner 10 of this invention provides a compact, lightweight, 3-dimensional circuit, spatial field power combiner, useful for combining a multiplicity of low-power travelling wavetubes or solid state devices having desirable bandwidth properties. The combiner is especially suited for high-average power applications and has the following features: balanced TEM mode propagation; low-loss, high-combining efficiency of greater than 90%; multi-octave bandwidth operation; high-degree of isolation between the amplifiers connected to the multiple inputs of the combiner; graceful degradation characteristics; and excellent heat sinking properties.

Figure 8:
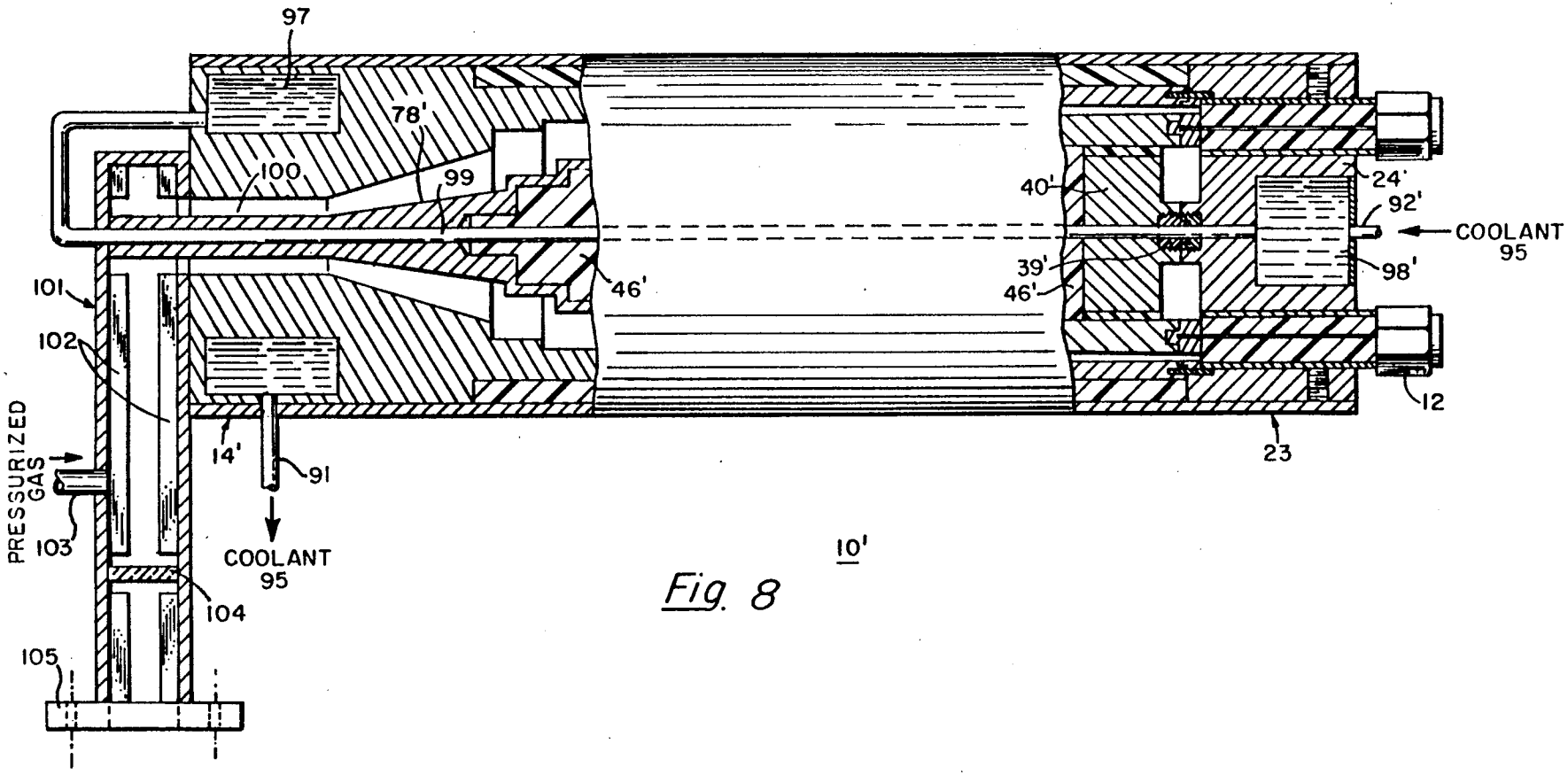
FIG. 8 is a cross-sectional view of another embodiment of the invention.

FIG. 8 shows another embodiment of a combiner 10' incorporating the invention but adapted to operate with even higher input and output RF power than the combiner 10 of FIG. 2. Combiner 10' has a axially extending pipe 99, which allows coolant fluid 95 to pass from an input chamber 98' and entry pipe 92' to the other end 14' where it exits. Chamber 98' serves the function of cooling the end 24'. Cylinder 40', screw 39', microwave absorbing cylinder 46', and coaxial lines 78', 100 have a central axially extending hole through which pipe 99 passes. Pipe 99 is in good thermal contact with their holes in order to provide good heat transfer. Pipe 99 exits end 14' and carries the coolant fluid 95 into chamber 97 to cool end 14' from which fluid 95 exits through pipe 91. The more efficient cooling provided by the axially extending pipe 99 and the coolant fluid 95 contained therein allows the combiner to operate at much higher input and output power levels than could be tolerated by the embodiment of FIG. 2. Because of the higher power level contained in the output coaxial line 100, combiner 10' utilizes a ridged waveguide 101 to couple the output power from the coaxial line 100 instead of using a coaxial output connector 13, such as shown in FIG. 2. A standard Type N or Type SC connector 13 would arc at the power level at which the combiner 10' is capable of operating. The ridged waveguide 101 contains a centrally extending ridge 102 and and alumina window 104 which seals the interior of the ridged waveguide 101. Sealing allows pressurized gas to be applied through gas pipe 103 to the sealed interior of ridged waveguide 101 and to the sealed interior of the combiner 10' which is sealed at its end 24' (seal not shown) to prevent the escape of the pressurized gas. The non-pressurized portion of the ridged waveguide 101 beyond the sealing alumina window 104 is a continuation of the ridged waveguide 101 which is terminated by output flange 105 to which a high-power load can be connected. It is anticipated that the combiner 10' of FIG. 8 will be able to provide output powers of 1000 watts or greater without causing overheating of the combiner 10' or arcing within the combiner interior spaces and the ridged waveguide 101.

It will also be recognized by those skilled in the art that the structure of this invention also may be used as a power divider for obtaining multiple sources of identical microwave energy from one source connected to connector 13 and with the output loads connected to connectors 12. The multiple sources will have the same amplitude and phase over a wide frequency band.

Having described a preferred embodiment of the invention, it will not be apparent to one skilled in the art that other embodiments incorporating its concept may be used. It is believed, therefore, that this invention should not be restricted to the disclosed embodiment, but rather should be limited only by the spirit and scope of the appended claims.

We claim:

1. A transition between a coaxial transmission line and a planar transmission line comprising:

an offset coaxial line having an inner conductor and an outer conductor, said inner conductor being non-coaxial with said outer conductor and thus offset from said outer conductor, with said inner conductor of said offset coaxial line being disposed between said inner conductor of said coaxial transmission line and a first conductor of said planar transmission line, and said outer conductor of said offset coaxial line being disposed between said outer conductor of said coaxial transmission line and a second conductor of said planar transmission line;

a cylindrical cavity; and a cylindrical metallic sleeve disposed between said cylindrical cavity, and said planar transmission line, and wherein said inner conductor of said offset coaxial line is disposed within said metallic sleeve.

2. The transition as recited in claim 1 wherein said cylindrical cavity has a resonant frequency and length such that said resonant frequency of said cavity is greater than an operating frequency of a signal fed to said offset coaxial line from either said coaxial transmission line or said planar transmission line.

3. A signal combiner comprising:

a plurality of coaxial input transmission lines disposed at a first end of the signal combiner, each coaxial input transmission line having an inner conductor dielectrically spaced from an outer conductor and coaxial with said outer conductor;

a plurality of planar transmission lines, each line having a first and a second conductor;

a respective one of a plurality of field transforming lines coupled between each of said coaxial input transmission lines and a first end of a corresponding one of said plurality of said planar transmission lines, each of said plurality of field transforming lines comprising:

a coaxial line having an inner and outer conductor, said inner conductor being non-coaxial with said outer conductor, and said inner conductor being disposed between said inner conductor of said coaxial transmission line and said first conductor of said planar transmission line and said outer conductor of said offset coaxial line being disposed between said outer conductor of said coaxial transmission line and said second conductor of said planar transmission line;

a signal absorber disposed adjacent to said plurality of planar transmission lines; and means for combining a second end of each of said plurality of planar transmission lines.

4. The combiner of claim 3 wherein said means for combining a second end of each of said plurality of planar transmission lines comprises:

a plurality of impedance transforming lines, each one of said plurality of impedance transforming lines connected at one end to a respective one of said plurality of planar transmission lines, and each impedance transformer line having another end connected in parallel with each other to provide the output of said combiner.

5. The combiner of claim 4 further comprising:

a plurality of R.F. sources wherein each one of said plurality of R.F. sources is coupled to a respective one of said plurality of coaxial transmission lines.

6. The combiner claim 5 wherein each of said plurality of R.F. sources provides a signal having a phase and amplitude over a predetermined frequency band.

7. The combiner of claim 3 wherein, each of said plurality of planar lines is spatially separated from each other planar transmission lines with the first plane conductor of each planar line being nearest each other having the same instantaneous polarity in a balanced mode, said balanced mode having a field substantially of the same phase and confined between the first and second conductors of each of said plurality of planar transmission lines, and wherein said signal absorber is a composite absorber, comprising:

a first absorber disposed adjacent to each of said first conductors of said planar transmission lines; and a second absorber disposed adjacent to each of said second conductors of said planar transmission lines, wherein unbalanced mode fields provided between the first and second plane conductors of adjacent planar transmission lines are attenuated by said first and second absorbers.

8. An RF circuit comprising:

a plurality of signal channels, each signal channel comprising:

(a) a signal terminal disposed at a first end of the circuit;

(b) a coaxial transmission line having a first end coupled to said signal terminal;

(c) a planar transmission line disposed along a longitudinal axis of the circuit;

(d) means, coupled between a second end of said coaxial transmission line and a first end of said planar line, for transforming an electric field associated with said coaxial line to an electric field associated with said planar line, comprising:

(i) an inner conductor having a first end spaced at a first radial distance from said longitudinal axis and a second end disposed at a second radial distance from said longitudinal axis, said second radial distance being less than said first radial distance; and (ii) an outer conductor spaced from said inner conductor by a predetermined radial distance; and a signal absorber, disposed adjacent to said plurality of signal channels.

9. The RF Circuit of claim 8 wherein pairs of said inner conductors and corresponding outer conductors are spaced from each other with said outer conductors spaced at a first distance and said the inner conductors spaced at a second, different distance with said distances disposed along a common radius.

10. The RF circuit as recited in claim 9 wherein said signal absorber comprises:

a first cylindrical member comprised of an RF absorbing material, said cylindrical member disposed adjacent to the first planar conductor of the planar transmission line of each of the plurality of channels; and a second cylindrical member comprised of an RF absorbing material, said second cylindrical member disposed adjacent to the second planar conductor of the planar transmission line of each of the plurality of channels.

11. The RF circuit as recited in claim 10 wherein each of said means for transforming an electric field comprises:

a cavity resonator, disposed adjacent to said coaxial transmission line and to said first planar conductor of said respective planar transmission line, having a resonant frequency greater than a frequency within an operating band of frequencies of said circuit.

12. The RF circuit as recited in claim 11 wherein each of said cavity resonators comprises:

an electrically conductor cylinder having a length corresponding to a quarter of a wavelength at said resonant frequency with a wall portion of said cylinder providing a first wall of said cavity; and a support member having a second wall of electrically conductive material disposed opposite said first wall and providing a second wall of said cavity with said first and second walls being spaced by a distance which is related to the resonant frequency of said cavity.

13. The RF circuit as recited in claim 12 wherein each of said electrically conductive cylinders is disposed concentric with a corresponding coaxial transmission line and said electrically conductive cylinder is coupled to the first planar conductor of said respective planar transmission line.

14. The RF circuit as recited in claim 13 further comprising:

means, coupled to each planar transmission line, for providing a terminal common to each of said plurality of signal channels.

15. The RF circuit as recited in claim 14 wherein said means for providing a common terminal comprises:

a waveguide coupled between each one of said planar transmission lines and said common terminal of the circuit.

16. The RF circuit as recited in claim 15 wherein said waveguide is comprised of a first outer conductor and a plurality of stepped conductors, with each one of said plurality of stepped conductors having one end connected to corresponding first planar conductors of said plurality of channels and each having a second end connected together at said common terminal of said circuit.

17. The RF circuit as recited in claim 16 further comprising:

a housing, with said RF circuit disposed in said housing; and means, disposed in said housing, for for cooling said housing.

18. The RF circuit as recited in claim 17 wherin said circuit further comprises:

means, coupled to said housing, for providing a pressurized gas flow to said plurality of stepped conductors and said planar transmission lines.

* * * * *